US005655754A

United States Patent [19]

Perrier

[11] Patent Number: 5,655,754

[45] Date of Patent: Aug. 12, 1997

[54] PULLING OR LIFTING APPARATUS WITH JAWS, ACTING ON FLAT-PROFILED FLEXIBLE STRAPS

[76] Inventor: Denis Perrier, 24, rue de la Boule d'Or, F-, 10100 Rouilly S/Seine, France

[21] Appl. No.: 502,096

[22] Filed: Jul. 13, 1995

[30] Foreign Application Priority Data

Jul. 18, 1994 [FR] France ..... 94 08860

[51] Int. Cl.[6] ..... B66F 1/00

[52] U.S. Cl. ..... 254/384; 254/264; 254/254; 226/112

[58] Field of Search ..... 254/264, 384, 254/254; 226/112, 147, 165, 160

[56] References Cited

U.S. PATENT DOCUMENTS

| | | | |
|---|---|---|---|
| 2,990,091 | 6/1961 | Goldsworthy et al. | 226/112 |
| 3,222,742 | 12/1965 | Persiaux | 254/264 X |
| 3,528,139 | 9/1970 | Desplats | 254/264 X |
| 3,902,228 | 9/1975 | Caradot | 254/264 X |
| 4,480,816 | 11/1984 | Gortan | 254/384 X |
| 4,483,517 | 11/1984 | Cavalieri | 254/384 X |
| 4,593,884 | 6/1986 | Zschocke et al. | 254/264 |

*Primary Examiner*—Daniel P. Stodola
*Assistant Examiner*—Emmanuel M. Marcelo
*Attorney, Agent, or Firm*—Thomas S. Baker, Jr.

[57] ABSTRACT

A pulling or lifting apparatus for a flat, flexible strap connected to a load operates with two pairs of reciprocating jaws. The pairs of jaws have flat gripping surfaces corresponding to the flat faces of the flexible flat-profiled strap. Two guide members are disposed along each of the two broad faces of the strap and follow its longitudinal direction in order to prevent the strap from moving to form a fold or loop between the two pairs of jaws when these approach one another.

24 Claims, 3 Drawing Sheets

FIG. 2
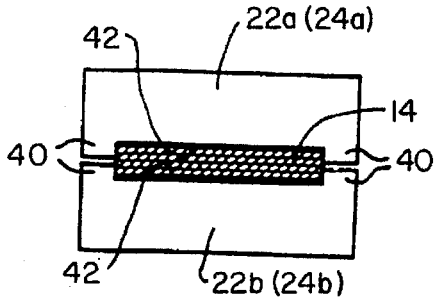
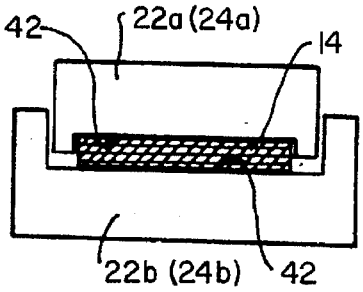
FIG. 3B
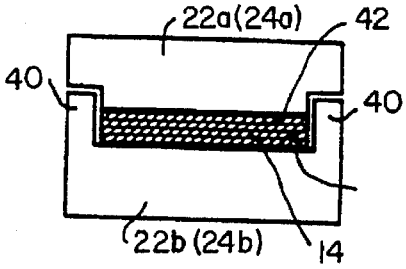
FIG. 3
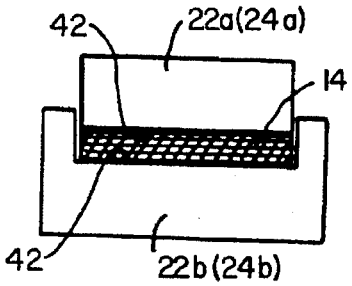
FIG. 3A
FIG. 4
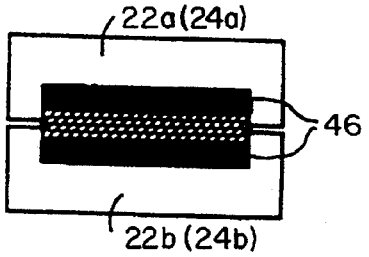
FIG. 5
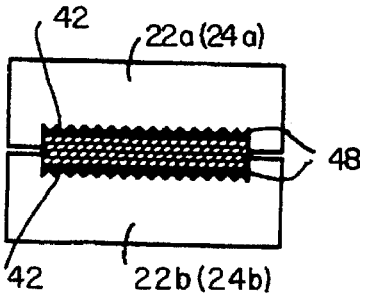

FIG. 6
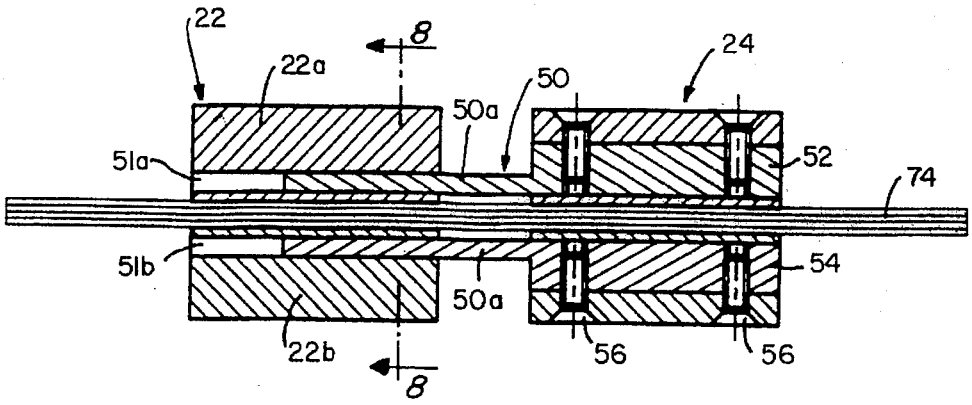
FIG. 7
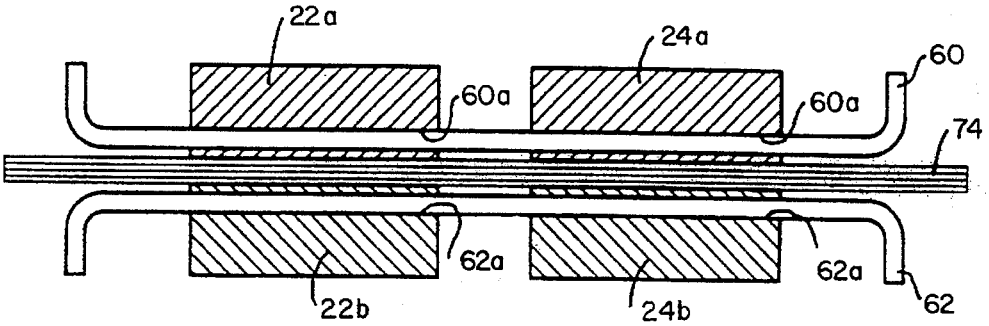
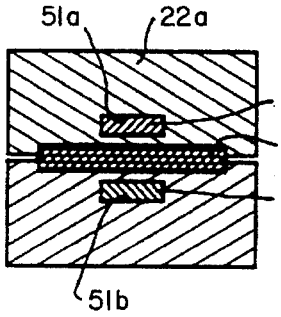
FIG. 8A
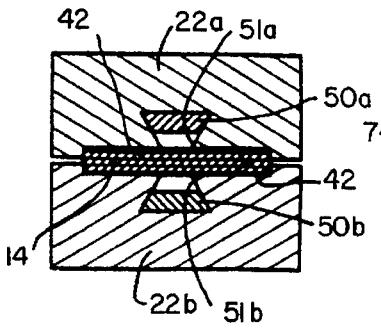
FIG. 8B
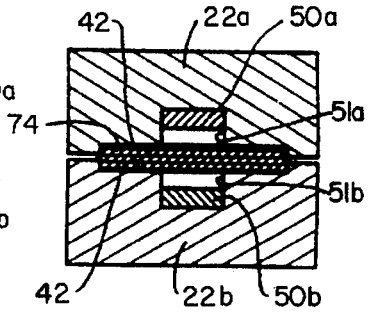
FIG. 8C

PULLING OR LIFTING APPARATUS WITH JAWS, ACTING ON FLAT-PROFILED FLEXIBLE STRAPS

The invention relates to a pulling or lifting apparatus with a connection joined to a lead, operating by means of two pairs of jaws with reciprocating motion, in particular following the principle of automatic gripping via the lead and in particular also provided with a device for no-lead pro-gripping and for simultaneous decoupling of the two pairs of jaws.

Hoisting jaws for lifting or lowering a lead by means of a lever mechanism operating two pairs of jaws in reciprocating motion are known, in which one of the pairs of jaws is locked onto a cable in the direction of displacement of the lead, while the other pair of jaws unlock in the opposite direction. Such systems are described, in particular, in the French patent 914 400.

Until now, these systems were only designed to maneuver a round metal cable, which constitutes a relatively inflexible connection.

The object of the present invention is to provide a mechanical assembly of the same kinematic design as indicated above to maneuver a flat and flexible strap used as a connection for the displacement of a load.

To this end, the present invention replaces the pairs of jaws of known type, designed to grip a metal cable with a round cross-section, by pairs of jaws equipped with flat gripping surfaces corresponding to the broad surfaces of a flexible, flat-profiled strap and completed by two guide means disposed along each of the respective two broad faces of the strap and following its longitudinal direction in such a way as to prevent said strap from moving to form a fold or loop between the two pairs of jaws when these approach one another.

Since most straps, in particular woven straps, are relatively flexible, the strap is able to fold in its section contained between the two pairs of jaws when these approach one another. To prevent this folding movement, the guide means are arranged according to the invention along each broad face of the strap parallel to its longitudinal axis.

These guide means are fastened so that they stay in position and retain their function on a length contained between the two pairs of jaws at least equal to their greatest distance from one another without hindering the jaws in the their gripping and displacement movement.

As these two guide means have to be constantly in contact, or virtually in contact, with the strap in order to prevent any irregularity in its movement, and as they must not come between the inside faces of the jaws and the strap, it is therefore necessary for them to be positioned on the longitudinal path of the jaws without hindering their displacement movement and without their gripping movement applying pressure to the guide means and onto the strap.

Therefore, at least two of the four jaws, which are not situated on the same side of the strap, should slide on the guide means located to the side in relation to the strap via longitudinal cavities, which are arranged in these jaws and have a cross-section corresponding to that of said guide means, whilst the other end of each guide means must be fixed to the jaw of the other pair.

For obvious construction reasons, a guide means cannot, of course, be fastened on two jaws situated on the same side of the strap simultaneously.

According to another embodiment, the guide means are fixed respectively to either one of the ends or both ends of the casing of the apparatus, which means that all the jaws slide on the guide means in the same way.

The longitudinal cavity of the jaws could close laterally to the inside of the jaw or open laterally onto the internal face of the jaw or of a gripping plate thereof.

In the latter case, the cross-section of the cavity may have an appropriate form, such as a dovetail shape, to interact with a corresponding form of the cross-section of the guide means to prevent this from shifting laterally out if its seat.

In all cases, the gripping action of the jaws on the strap must not apply positive pressure on the guide means against the strap.

It is thus evident that the guide rods act as guide means both for the strap and for the jaws.

The sides of the jaws fitted with gripping surfaces may be flat, but in order to wedge the strap laterally in each pair of jaws, one of the jaws or both jaws of each pair may be provided with two lateral raised sections bordering the gripping surfaces. According to another embodiment, one of the jaws, with or without lateral raised sections, is positioned on the inside of its opposing jaw provided with lateral raised sections, and together with this forms an enclosure for the strap.

Gripping plates made of an appropriate material and attached to the inside faces of the jaws may be fitted to provide optimum adhesion conditions between jaw and strap.

Additionally, the inside face of the jaws or of their gripping plates may be provided with indentations or elevations to improve the interaction between the jaws and strap.

The pulling or lifting apparatus will be explained in greater detail below with reference to the attached drawings.

FIGS. 2, 3, 3A, 3B, 4 and 5 show different embodiments of the jaws;

FIG. 6 shows a strap guide attached to one of the jaw blocks;

FIG. 7 shows a strap guide attached to the casing of the pulling or lifting apparatus, and FIGS. 8*a*, 8*b* and 8*c* show the guidance of the strap guide in the jaws.

Figure 1:
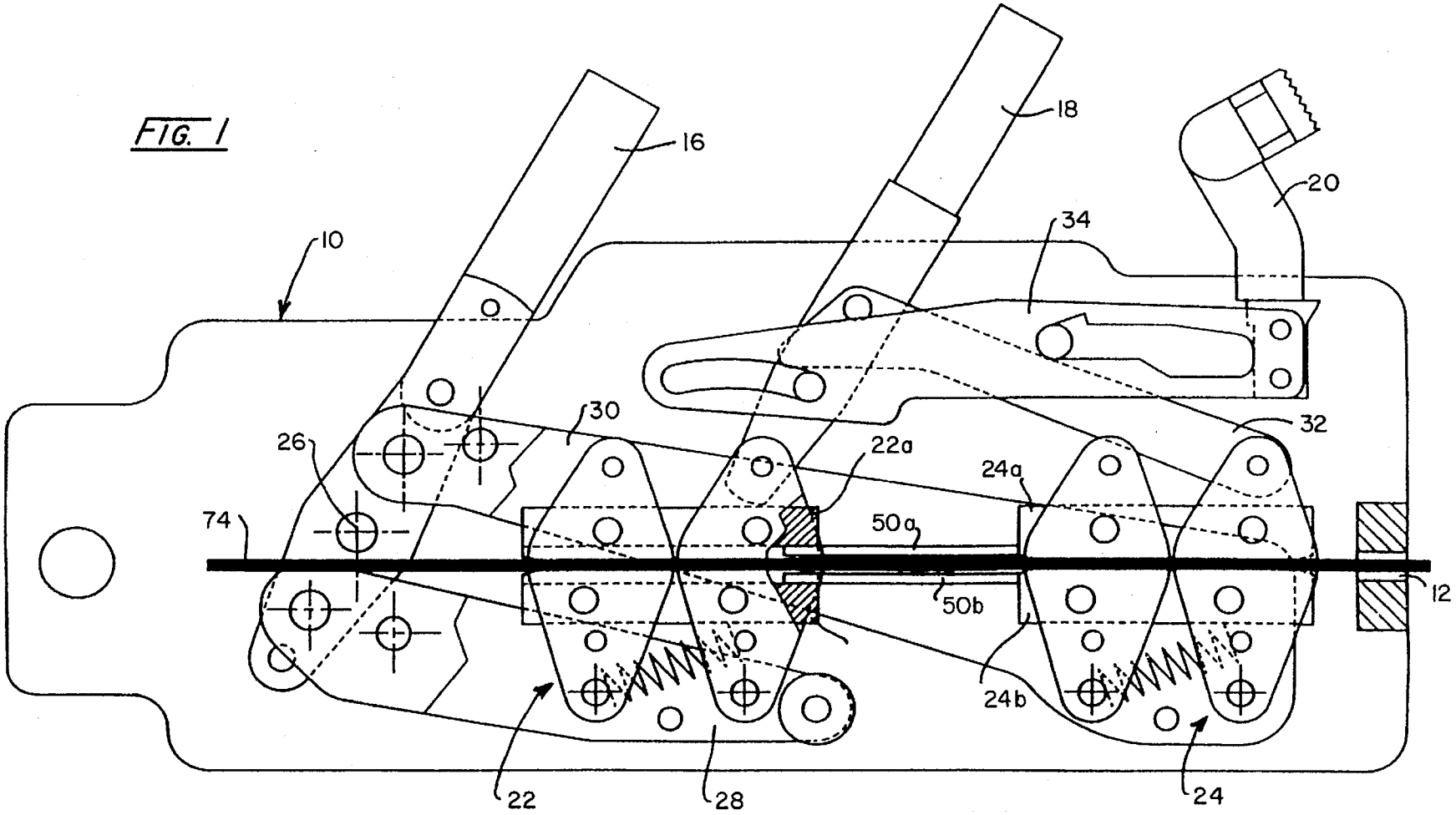
FIG. 1 is a schematic view of the pulling or lifting apparatus equipped with jaws provided with a strap guide according to an embodiment of the present invention.

The casing 10 of a pulling or lifting apparatus is shown schematically in FIG. 1. This casing has an inlet passage 12, through which the strap 14 passes into the interior of the casing 10. The strap exits from the casing of the apparatus via an outlet (not shown) provided at the opposite end of the casing 10.

The apparatus is equipped with a forward motion lever 16 and a reverse motion lever 18 and also with a decoupling handle 20. Two blocks of jaws 22, 24, each comprising two jaws 22*a*, 22*b* and 24*a*, 24*b* respectively, are disposed on the inside of the casing 10. The forward motion lever 16 is mounted to pivot around an axis 26 fixed in relation to the casing 10. The forward motion lever 16 is connected via a tie rod 28 to the front block of jaws 22 and via a tie rod 30 to the rear block of jaws. The reverse motion lever 18 is pivotally connected to the front block of jaws 22 and a tie rod 32 is pivotally connected to the reverse motion lever 18 and the rear block of jaws 24. The decoupling handle 20 is connected via a rocker bar 34 to the reverse motion lever 18.

The construction of a pulling or lifting apparatus described above, as well as its operation, are well known in the art relating to systems for manoeuvring a metal cable, and do not need to be explained in greater detail here. The difference between the pulling or lifting apparatus according to the present invention and the apparatus of the prior art lies in the form and construction of the blocks of jaws which are designed according to the present invention to interact with the flexible strap 14 instead of the metal cable. It is sufficient to mention here that by pivoting the forward motion lever 16, the strap 14 is moved forward to the left-hand side. When lever 16 is pivoted in counter-clockwise direction, the two jaws 24*a* and 24*b* of the rear block of jaws 24 grip the strap between them and, together with the strap, are displaced forwards or to the left. At the same time, the jaws 22*a* and 22*b* draw back from the strap and the front block of jaws 22 is shifted to the rear to enable the two blocks of jaws to approach one another. When the forward motion lever 16 is pivoted again towards the right-hand side in clockwise direction around axis 26, the movement of jaws 22 and 24 is reversed, i.e. the jaws move away from one another. The front block of jaws 22 now grips the strap to move it forward to the left, while the rear block of jaws 24 shifts freely to the rear on the strap.

When the reverse motion lever 18 is pivoted forwards in counter-clockwise direction around its pivot connecting it to the front block of jaws 22, the two jaws 22 and 24 approach one another, the front block of jaws 22 gripping the strap to shift it to the right, while the rear block of jaws 24 slides on the strap. The two blocks of jaws 22 and 24 are shifted in opposite directions when the reverse motion lever 18 is pivoted in the opposite direction, i.e. in clockwise direction. The two blocks of jaws 22 and 24 now move apart from one another with the strap wedged in the block of jaws 24 and the block of jaws 22 sliding on the strap while moving away from the blocker jaws 24. In order to insert the strap 14 into the pulling or lifting apparatus, the two blocks of jaws 22 and 24 must be brought into their open position. This is achieved by pushing the decoupling handle 20 towards the left which, via rocker bar 34, reverse motion lever 18 and tie bar 32, acts on the two blocks of jaws 22 and 24 to open them. Apart from the jaws designed to interact with a flexible strap, the pulling or lifting apparatus of the construction described above is known in the prior art.

In the most simple embodiment (not shown), the jaws have a simple rectangular cross-section.

According to FIG. 2, the jaws 22*a*, 22*b*, 24*a* and 24*b* of each pair of jaws are each provided with a U-shaped cross-section with a raised section 40 on each side of the gripping surface 42 with the two U-shaped forms facing one another on each engagement of the jaws.

In this way, an enclosure with a rectangular flattened cross-section is provided to receive the strap in the inside faces of the jaws. This enclosure allows the strap to be guided laterally between the jaws of the same pair.

According to a variation shown in FIG. 3*a*, only one 22*b*, 24*b* of the jaws of the same pair is U-shaped, the other jaw 22*a*, 24*a* with a simple rectangular cross-section being dimensioned so as to allow it to be accommodated between the arms of the opposing U-shaped jaw.

According to another embodiment shown in FIG. 3, one of the jaws 22*b*, 24*b* is U-shaped, while the other jaw 22*a*, 24*a* of the same pair is T-shaped, being provided with lateral shoulders and the central portion of the T engaging into the enclosure of the U-shaped opposing jaw.

According to a fourth embodiment shown in FIG. 3*b*, the two jaws 22*a*, 24*a*, 22*b*, 24*b* of the same pair are U-shaped and face one another, as in the embodiment according to FIG. 2, with the difference that one of the two jaws is broader than the other to allow it to engage therein during the gripping movement.

In the various forms of enclosure for the strap 14 in the above figure, the legs or shoulders of the jaw are dimensioned in the direction in which the strap is gripped so that two opposing jaws will never come into abutment against one another when the movement for gripping the strap 14 is taken to its maximum limit.

The embodiments according to FIGS. 4 and 5 correspond to the embodiment in FIG. 2 with the exception that, according to the embodiment in FIG. 4, gripping plates 46 made of appropriate materials are provided between opposite jaws 22*a*, 22*b* and 24*a*, 24*b* and the strap 14 to ensure maximum adhesion between the jaws and the strap. According to FIG. 5, the gripping surfaces 42 of jaws 22*a*, 22*b* and 24*a*, 24*b* are provided with indentations and/or elevations 48 designed to optimise cooperation between the jaws and the strap. Such plates or indentations and/or elevations may, of course, also be provided in the embodiment according to FIGS. 3, 3*a* and 3*b*. The plates may also be provided with indentations and/or elevations to permit optimum gripping of the strap.

FIG. 6 shows a first embodiment of a strap guide attached to the upstream block of jaws 24. This strap guide 50 has two guide pieces 52 and 54. Each guide piece 52 and 54 has a head section attached by screws 56 to one of the jaws 24*a*, 22*b* of the rear block of jaws 24*b* and has a guide arm 50*a*, 50*b* which extends axially and is received in one of jaws 22*a*, 22*b* of the front block of jaws 22. The guide arms 50*a*, 50*b* of the strap guide 50 are arranged to allow sliding movement in the corresponding cavities 51*a*, 51*b* provided in the jaws 22*a*, 22*b* of the front block of jaws 22, and are respectively disposed along each of the two broad faces of the strap 14 in its longitudinal direction in order to prevent said strap from moving to form a fold or loop between the two blocks of jaws 22 and 24 when these approach one another. This embodiment is also shown in FIG. 1, i.e. guide arms 50*a*, 50*b* of rear jaws 24*a*, 24*b* received in the passages provided in the front jaws 22*a* and 22*b*.

According to the embodiment in FIG. 7, the upper jaws 22*a*, 24*b* slide on a strap guide or fixed slide 60 located on the upper side of the strap 14, whilst jaws 22*b*, 24*b* slide on a similar strap guide or fixed slide 62 located on the lower side of the strap 14. The two slides 60 and 62 are attached to one or both ends of the casing 10 of the lifting or pulling apparatus. The slides 60 and 62 are provided for the same purpose as guide pieces 52, 54 in the embodiment according to FIG. 6, i.e. they serve to prevent the strap 14 from moving to form a fold or loop between the two blocks of jaws 22 and 24 while these are approaching one another.

FIGS. 8*a*, 8*b* and 8*c* are cross-sectional views along line 8—8 in FIG. 6 of jaws 22*a*, 22*b* of the front block of jaws 22. As shown in FIG. 8*a*, the sliding cavities 51*a*, 51*b* for guide arms 50*a*, 50*b* are laterally closed to the inside of jaws 22*a*, 22*b* and have a section corresponding to that of guide arms 50*a*, 50*b*. According to FIG. 8*c*, the sliding cavities 51*a*, 51*b* provided in jaws 22*a*, 22*b* for the guide arms 50*a*, 50*b* are formed by longitudinally open grooves on the gripping surface 42 of the jaws 22*a* and 22*b*, whilst according to FIG. 8*b*, the longitudinally open groove for sliding jaws 22*a*, 22*b* on the guide arms 50*a*, 50*b* has a dovetailed cross-section which cooperates with the section of the guide arm to prevent the guide arm from shifting out of this groove.

The cavities 60*a*, 62*a* provided in jaws 22*a*, 22*b* and 24*a*, 24*b* in the embodiment in FIG. 7 for sliding assembly on the slides 60 and 62 may also be formed as shown in FIGS. 8*a*, 8*b* and 8*c*.

I claim:

1. Pulling or lifting apparatus for connection to a load supported by a flexible, flat-profiled strap having a pair of opposed faces having two pairs of jaws (22*a*, 22*b*; 24*a*, 24*b*)

mounted in a casing (10) for reciprocating motion therein, said apparatus adapted to automatically grip the strap and said apparatus further having a device for no-load pre-gripping and for simultaneous decoupling (20) of the two pairs of jaws (22*a*, 22*b*; 24*a*, 24*b*), characterized in that said two pairs of jaws (22*a*, 22*b*; 24*a*, 24*b*) are equipped with flat gripping surfaces (42) corresponding to the surfaces of said flexible, flat-profiled strap (14); and two guide means (50*a*, 50*b*; 60, 62) positioned adjacent said pairs of jaws and adapted to be disposed along each of said opposed faces of the strap (14) such that said guide means overlies the strap between said pairs of jaws (22*a*, 22*b*; 24*a*, 24*b*) and follows the longitudinal direction of said strap to prevent said strap from moving to form a fold or loop between the two pairs of jaws (22*a*, 22*b*; 24*a*, 24*b*) when said pairs of jaws approach one another.

2. Apparatus according to claim 1, characterized in that at least one of said pair of jaws (22*a*, 22*b*; 24*a*, 24*b*) have two lateral raised sections (40) bordering a gripping surface (42).

3. Apparatus according to claim 2, characterized in that one of the jaws (22*a*, 24*a*) is engaged in an opposing jaw (22*b*; 24*b*) having lateral raised sections (40) and said pair of jaws provide an enclosure for said strap (14) to pass through or be gripped.

4. Apparatus according to claim 3, characterized in that gripping plates (46) of an appropriate material for providing optimum adhesion between the jaw and the strap are positioned between said pairs of jaws (22*a*, 22*b*; 24*a*, 24*b*).

5. Apparatus according to claim 4 characterized in that one of the gripping surface (42) of the jaws (22*a*, 22*b*; 24*a*, 24*b*) and their plates (46) are provided with one of indentations and elevations (48) designed to optimize interaction between the jaws (22*a*, 22*b*; 24*a*, 24*b*) and the strap (14).

6. Apparatus according to claim 3, characterized in that the gripping surface (42) of the jaws (22*a*, 22*b*; 24*a*, 24*b*) are provided with one of indentations and elevations (48) designed to optimize interaction between the jaws (22*a*, 22*b*; 24*a*, 24*b*) and the strap (14).

7. Apparatus according to claim 2, characterized in that gripping plates (46) of an appropriate material for providing optimum adhesion between said jaws and the strap are positioned between said pairs of jaws (22*a*, 22*b*; 24*a*, 24*b*).

8. Apparatus according to claim 7, characterized in that one of the gripping surface (42) of the jaws (22*a*, 22*b*; 24*a*, 24*b*) and their gripping plates (46) are provided with one of indentations and elevations (48) designed to optimize interaction between the jaws (22*a*, 22*b*; 24*a*, 24*b*) and the strap (14).

9. Apparatus according to claim 2, characterized in that the gripping surface (42) of the jaws (22*a*, 22*b*; 24*a*, 24*b*) are provided with one of indentations and elevations (48) designed to optimize interaction between the jaws (22*a*, 22*b*; 24*a*, 24*b*) and the strap (14).

10. Apparatus according to claim 1, characterized in that one of the jaws (22*a*, 24*a*) is engaged in an opposing jaw (22*b*; 24*b*) having lateral raised sections (40) and said pair of jaws provide an enclosure for said strap (14) to pass through or be gripped.

11. Apparatus according to claim 10, characterized in that gripping plates (46) of an appropriate material for providing optimum adhesion between said jaws and the strap are positioned between said pairs of jaws (22*a*, 22*b*; 24*a*, 24*b*).

12. Apparatus according to claim 11, characterized in that one of the gripping surface (42) of the jaws (22*a*, 22*b*; 24*a*, 24*b*) and their gripping plates (46) are provided with one of indentations and elevations (48) designed to optimize interaction between the jaws (22*a*, 22*b*; 24*a*, 24*b*) and the strap (14).

13. Apparatus according to claim 10 characterized in that the gripping surface (42) of the jaws (22*a*, 22*b*; 24*a*, 24*b*) are provided with one of indentations and elevations (48) designed to optimize interaction between the jaws (22*a*, 22*b*; 24*a*, 24*b*) and the strap (14).

14. Apparatus according to claim 1, characterized in that gripping plates (46) of an appropriate material for providing optimum adhesion between said jaws and the strap are positioned between said pairs of jaws (22*a*, 22*b*; 24*a*, 24*b*).

15. Apparatus according to claim 14, characterized in that one of the gripping surface (42) of the jaws (22*a*, 22*b*; 24*a*, 24*b*) and their gripping plates (46) are provided with one of indentations and elevations (48) designed to optimize interaction between the jaws (22*a*, 22*b*; 24*a*, 24*b*) and the strap (14).

16. Apparatus according to claim 1, characterized in that the gripping surface (42) of the jaws (22*a*, 22*b*; 24*a*, 24*b*) are provided with one of indentations and elevations (48) designed to optimize interaction between the jaws (22*a*, 22*b*; 24*a*, 24*b*) and the strap (14).

17. Apparatus according to claim 1, characterized in that at least one of the jaws (22*a*, 24*a*) of one pair of said pairs of jaws slides on said guide means (50*a*) located on its side via a cavity (51*a*) arranged longitudinally in said one jaw (22*a*), said guide means (50*a*) having two ends, and wherein one of the ends of the guide means (50*a*) is attached to one jaw of the other of said pair of jaws (24*a*, 24*b*) and on the same side of the strap (14).

18. Apparatus according to claim 17, characterized in that a sliding cavity (51*a*, 51*b*; 60*a*, 60*b*) is defined in each of the jaws (22*a*, 22*b*; 24*a*, 24*b*); each of said jaws having an inside face; said sliding cavity (51*a*, 51*b*; 60*a*, 60*b*) being laterally closed to the inside face of said jaw (22*a*, 22*b*; 24*a*, 24*b* along a section corresponding to that of said guide means (50*a*, 50*b*; 60, 62).

19. Apparatus according to claim 17, characterized in that a sliding cavity (51*a*, 51*b*; 60*a*, 60*b*) is defined in each of the jaws (22*a*, 22*b*; 24*a*, 24*b*); said sliding cavity (51*a*, 51*b*; 60*a*, 60*b*) being a groove; an inside face is defined in each of said jaws (22*a*, 22*b*; 24*a*, 24*b*); and wherein said groove opens longitudinally onto the inside face of said jaw (22*a*, 22*b*; 24*a*, 24*b*).

20. Apparatus according to claim 19 characterized in that the section of said groove is shaped to cooperate with the section of said guide means (50*a*, 50*b*; 60, 62) to prevent the guide means (50*a*, 50*b*; 60, 62) from shifting out of said groove.

21. Apparatus according to claim 1, characterized in that all of the jaws (22*a*, 22*b*; 24*a*, 24*b*) slide respectively on the guide means (60, 62) located on the same side of the strap (14), said guide means (60, 62) being attached to at least one end of the casing (10) of the apparatus.

22. Apparatus according to claim 21 characterized in that a sliding cavity (51*a*, 51*b*; 60*a*, 60*b*) is defined in each of the jaws (22*a*, 22*b*; 24*a*, 24*b*); each of said jaws having an inside face; said sliding cavity (51*a*, 51*b*; 60*a*, 60*b*) being laterally closed to the inside face of said jaw (22*a*, 22*b*; 24*a*, 24*b*) along a section corresponding to that of said guide means (50*a*, 50*b*; 60, 62).

23. Apparatus according to claim 21, characterized in that a sliding cavity (51*a*, 51*b*; 60*a*, 60*b*) is defined in each of the jaws (22*a*, 22*b*; 24*a*, 24*b*); said sliding cavity (51*a*, 51*b*; 60*a*, 60*b*) being a groove; an inside face is defined in each of said jaws (22*a*, 22*b*; 24*a*, 24*b*); and wherein said groove opens longitudinally onto the inside face of said jaws (22*a*, 22*b*; 24*a*, 24*b*).

24. Apparatus according to claim 23, characterized in that the section of said groove is shaped to cooperate with the section of said guide means (50*a*, 50*b*; 60, 62) to prevent the guide means (50*a*, 50*b*; 60, 62) from shifting out of said groove.

* * * * *